US005328410A

United States Patent [19]

Amburgey et al.

[11] Patent Number: 5,328,410

[45] Date of Patent: Jul. 12, 1994

[54] TOY RIDING APPARATUS

[75] Inventors: James D. Amburgey, Richardson; Peter C. Hill, Dallas, both of Tex.

[73] Assignee: Today's Kids, Inc., Boonesville, Ark.

[21] Appl. No.: 14,373

[22] Filed: Feb. 5, 1993

[51] Int. Cl.[5] ..... A63K 1/00

[52] U.S. Cl. ..... 472/99; 472/103

[58] Field of Search ..... 472/103, 99, 95, 101; 482/130

[56] References Cited

U.S. PATENT DOCUMENTS

| | | | |
|---|---|---|---|
| D. 165,491 | 12/1951 | Spangler . | |
| D. 192,927 | 5/1962 | Ernst . | |
| D. 216,517 | 1/1970 | Dorn . | |
| D. 256,606 | 8/1980 | Hoggard . | |
| D. 275,975 | 10/1984 | Ciganko . | |
| D. 280,224 | 8/1985 | Wilson . | |
| D. 290,474 | 6/1987 | Tepper . | |
| 362,941 | 5/1887 | Crandall et al. | 472/95 |
| 366,571 | 7/1887 | Crandall | 472/95 |
| 385,792 | 7/1888 | Crandall | 472/95 |
| 2,364,081 | 12/1944 | Lambert . | |
| 2,554,045 | 5/1951 | Minor, Jr. . | |
| 2,756,051 | 7/1956 | Shone . | |
| 2,770,291 | 11/1956 | Forman . | |
| 2,882,050 | 4/1959 | Deady . | |
| 2,915,312 | 12/1959 | Barthel . | |
| 2,919,132 | 12/1959 | Canady | 472/101 |
| 2,921,789 | 1/1960 | Skinner, Sr. . | |
| 2,937,691 | 5/1960 | Horgan . | |
| 2,971,758 | 2/1961 | Zimmers . | |
| 3,037,769 | 6/1962 | Deady | 472/99 |
| 3,093,356 | 6/1963 | Buyalos, Jr. . | |
| 3,155,390 | 11/1964 | Moore et al. . | |
| 3,180,640 | 4/1965 | Lawrence . | |
| 3,220,726 | 11/1965 | Koller et al. . | |
| 4,072,309 | 3/1984 | Wilson . | |
| 4,492,375 | 1/1985 | Connelly . | |
| 4,582,320 | 4/1986 | Shaw . | |
| 4,618,144 | 10/1986 | Gibson . | |
| 4,852,874 | 8/1989 | Sleichter, III et al. . | |
| 4,913,419 | 4/1990 | McAuliffe . | |
| 4,943,046 | 7/1990 | Beltzig . | |
| 5,135,216 | 8/1992 | Bingham et al. . | |

FOREIGN PATENT DOCUMENTS

| | | | |
|---|---|---|---|
| 2938 | of 1887 | United Kingdom | 472/95 |
| 2075350 | 11/1981 | United Kingdom | 472/103 |

*Primary Examiner*—Carl D. Friedman
*Assistant Examiner*—Beth A. Aubrey
*Attorney, Agent, or Firm*—Kirkpatrick & Lockhart

[57] ABSTRACT

A toy riding apparatus is disclosed which includes a base, which base includes a plurality of support posts extending upwardly from the base, a rider support device, and a plurality of elastomeric suspension bands. Each of the bands is connected between the rider support device and one of the plurality of support posts such that the rider support device is suspended from the support posts by the bands.

18 Claims, 4 Drawing Sheets

TOY RIDING APPARATUS

BACKGROUND OF THE INVENTION

1. Field of the Invention

The present invention relates to children's toys and amusement devices. More particularly, the present invention relates to toy riding devices such as rocking horses.

2. Description of the Invention's Background

Many different types of rocking or riding toys have been developed for children. For example, U.S. Pat. No. Des. 290,474 to Tepper discloses an ornamental design for a rocking seahorse safety ring, and U.S. Pat. No. Des. 275,975 to Ciganko discloses an ornamental design for a rocking toy. In both the Tepper and the Ciganko design patents, however, the riding motion which is possible with the disclosed riding apparatuses is defined solely by rigid elements, such that the range of possible riding motion is restricted to one repeating path and the riding apparatuses are not as enjoyable to ride as apparatuses with more freedom of riding movement.

Other rocking or riding toys have been developed which allow a rider more freedom of movement. For example, U.S. Pat. No. 2,937,691 to Horgan discloses a riding toy which includes a frame on which a simulated horse is mounted by means of four coil springs. The frame includes four uprights to which the springs are connected. U.S. Pat. No. 2,756,051 to Shone discloses a hobby horse which includes a base made of hollow tubing and a carriage which is connected to the base by four coil springs. U.S. Pat. No. 3,155,390 to Moore, et al. discloses a hobby horse which includes a frame having four uprights, and a horse which is connected to the frame by means of four coil springs. U.S. Pat. No. 3,093,356 to Buyalos, Jr. discloses a hobby horse base which includes four uprights which support a hobby horse through four laterally protruding pins and four heavy duty coil springs. Suction cups are used to anchor the hobby horse base to the floor. U.S. Pat. No. Des. 165,491 discloses an ornamental design for a hobby horse.

U.S. Pat. No. 2,971,758 to Zimmers discloses a rotatable rocking toy which includes a body of a horse to which are secured transverse support members, a rotatable upper frame having upwardly diverging legs, and coil springs hooked to the support members and the legs. U.S. Pat. No. 2,915,312 to Barthel discloses a hobby horse having a base, end supports, a hollow horse's body mounted on spaced longitudinal bars, and springs secured to the end supports and the longitudinal bars. Also, U.S. Pat. No. 2,882,050 to Deady discloses a resiliently supported rider-actuated apparatus which includes a hobby horse, bolts connected to the hobby horse, and springs which are connected between the bolts and two pairs of standards. U.S. Pat. No. 3,180,640 to Lawrence discloses a revolving rocking horse which includes a molded horse body having a post extending downwardly therefrom to a pair of spring brackets, and springs which interconnect the outer apices of the spring brackets to upturned ends of a frame.

All of these riding or rocking toys utilize coil springs to connect a rocking horse or hobby horse to a base or frame and keep it suspended therefrom, and they thus all allow to at least some extent a greater freedom of riding motion than the rocking toys of the Tepper and Ciganko design patents. However, the addition of coil springs to riding and rocking toys has also added disadvantages to the toys. The coils of a coil spring naturally become spaced apart when the ends of the coil spring are pulled apart, i.e., when the coil spring is tensioned, and then quickly return to positions immediately adjacent one another when the ends thereof move back towards one another, i.e., when tension is released. Accordingly, the use of coil springs in a riding or rocking toy make it easy for a child's fingers or toes to be pinched between adjacent coils of a coil spring. In addition, since the coil springs are made of metal, they tend to squeak after they have been used for a period of time, which can make riding the toy a less desirable experience. The use of coil springs is also disadvantageous because coil springs tend to plastically deform relatively easily when they are subjected to prolonged cyclical stress, which can contribute to a ride which includes too much freedom of movement and thus feels unnatural.

In view of the above, it is an object of the present invention to provide an improved toy riding apparatus which is readily capable of being ridden by a child.

It is another object of the present invention to provide a toy riding apparatus which provides an extended range of riding motion.

A further object of the present invention is to provide a toy riding apparatus which presents a relatively reduced opportunity for a rider to be pinched by the apparatus.

It is a further object of the present invention to provide a toy riding apparatus which maintains a relatively quiet ride over time.

Another object of the present invention is to provide a toy riding apparatus which maintains a ride having a relatively natural feel over time.

SUMMARY OF THE INVENTION

The above objects as well as other objects not specifically enumerated are accomplished by a toy riding apparatus in accordance with the present invention. The toy riding apparatus of the present invention includes a base, which base includes a plurality of support posts extending upwardly from the base, a rider support device, and a plurality of elastomeric suspension bands. Each of the bands is connected between the rider support device and one of the plurality of support posts such that the rider support device is suspended from the support posts by the bands.

The objects of the invention are also accomplished by a toy riding apparatus which includes rider bearing means for bearing a rider during a riding motion, base means including support means extending upwardly from the base means for supporting the rider bearing means, and suspension means for suspending the rider bearing means from the support means. The suspension means includes a plurality of elastomeric band means which are connected between the rider bearing means and the support means.

The objects of the invention are further accomplished by a rocking horse which includes a base made of blow-molded plastic, wherein the base includes an integral step and four support posts extending upwardly from the base and wherein each of the support posts has a plurality of vertically spaced holes therein, and a rider support device shaped like a horse, wherein the rider support device includes a body made of a first roto-molded plastic and a saddle made of a second roto-molded plastic and wherein the second plastic is softer than the first plastic. The rocking horse further includes four support device pins attached to the support device at spaced locations thereon, four support post pins, wherein each of the support post pins extend into one of the holes in one of the support posts, respectively, and four elastomeric bands. Each of the bands includes two spaced retaining sections on either end of the band which each have a hole therethrough, two spaced elastic band sections which extend between the retaining sections, and a web section which extends between the retaining sections and the band sections. The retaining sections are made of a first rubber and the band sections and the web section are made of a second rubber, and the first rubber is harder than the second rubber. The retaining sections are thicker, in a first direction defined by the axes of the holes, than the band sections, and the band sections are thicker in the first direction than the web section. One of the support device pins and one of the support post pins extend through the holes of the retaining sections of each one of the bands such that each one of the bands is rotatably connected to the rider support device and one of the support posts, and the rider support device is thereby elastically suspended from the support posts by the bands.

BRIEF DESCRIPTION OF THE DRAWINGS

The preferred embodiment of the present invention will be described in greater detail with reference to the accompanying drawings, wherein like members bear like reference numerals and wherein.

DETAILED DESCRIPTION OF THE PREFERRED EMBODIMENT

Figure 1:
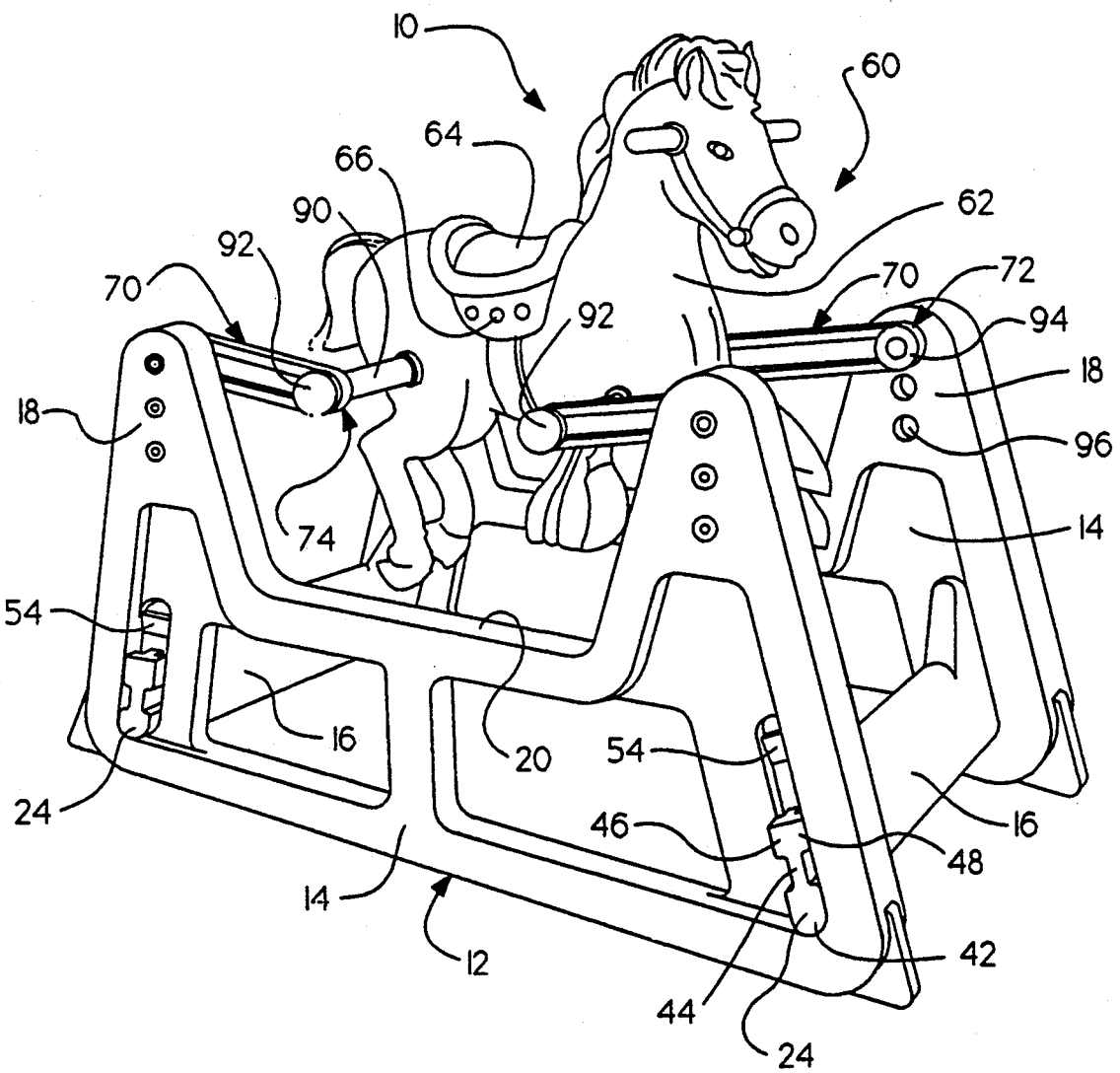
FIG. 1 is a perspective view of the toy riding apparatus of the present invention.

With reference to FIGS. 1–9, a toy riding apparatus 10 in accordance with an embodiment of the present invention includes a base 12 made up of two side pieces 14 and two braces 16, all of which are made of blow-molded plastic. Each of the side pieces 14 include two support posts 18 which extend upwardly therefrom, and an integral step 20.

Figure 2:
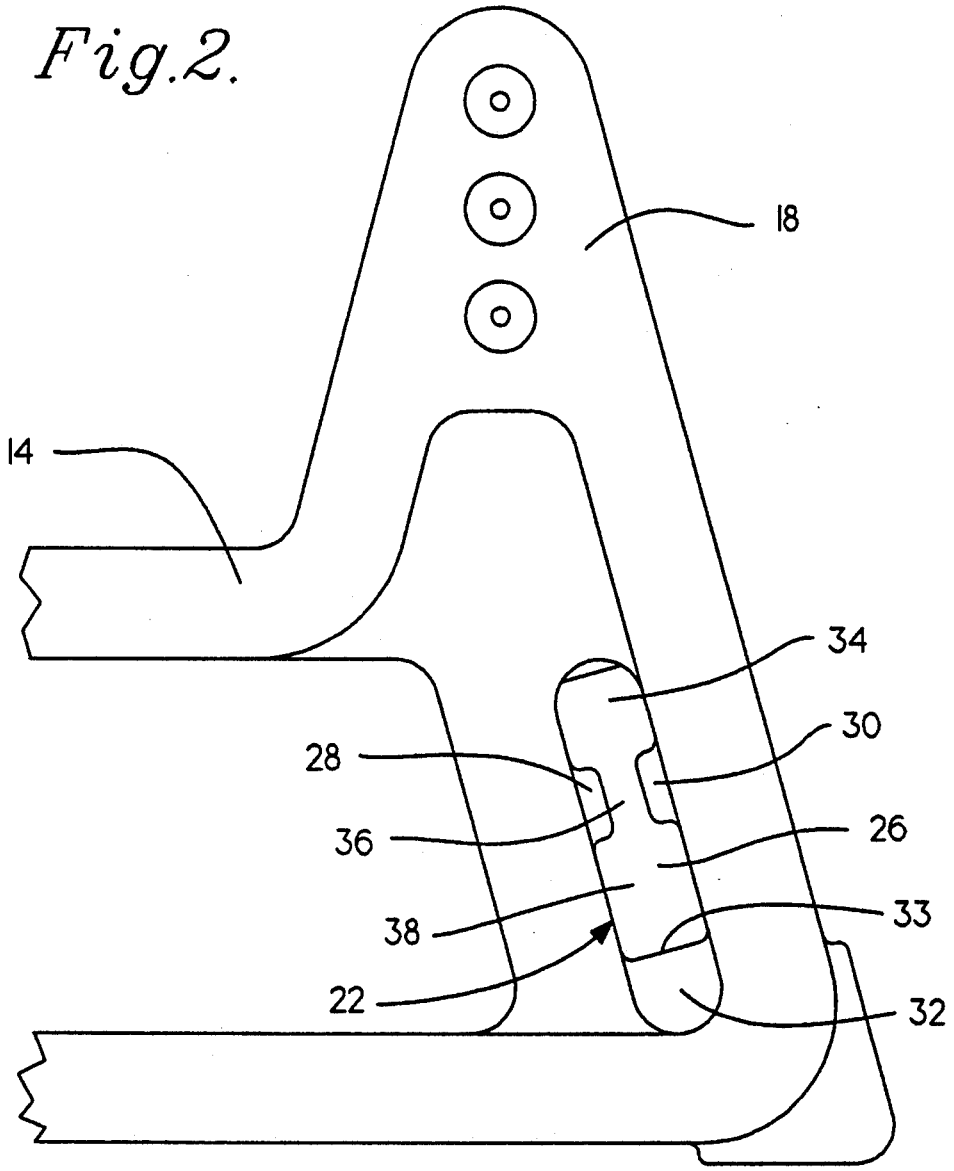
FIG. 2 is a front view of a portion of a side piece of a base of the toy riding apparatus of FIG. 1.
Figure 4:
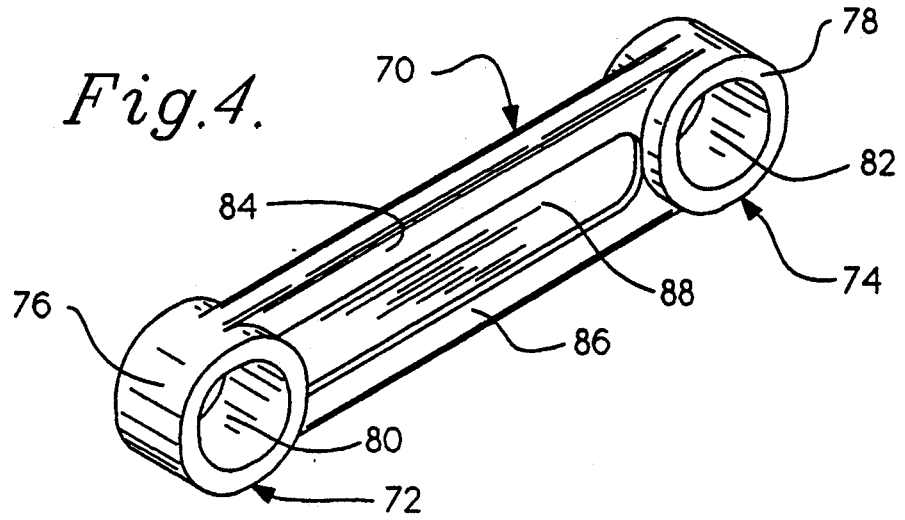
FIG. 4 is a perspective view of an elastomeric suspension band of the toy riding apparatus of FIG. 1.

As can be seen from FIG. 1 and from FIG. 2, which shows an end portion of one of the side pieces 14 (the opposite end portion being a mirror image of FIG. 2), each of the side pieces 14 includes two female connectors 22 which mate with male connectors 24 of the braces 16. Each female connector 22 includes a connection slot 26 into which protrudes two upper retaining tabs 28, 30 and a lower retaining tab 32. The connection slot 26 thus includes an upper section 34, a middle section 36, and a lower section 38.

Figure 3:
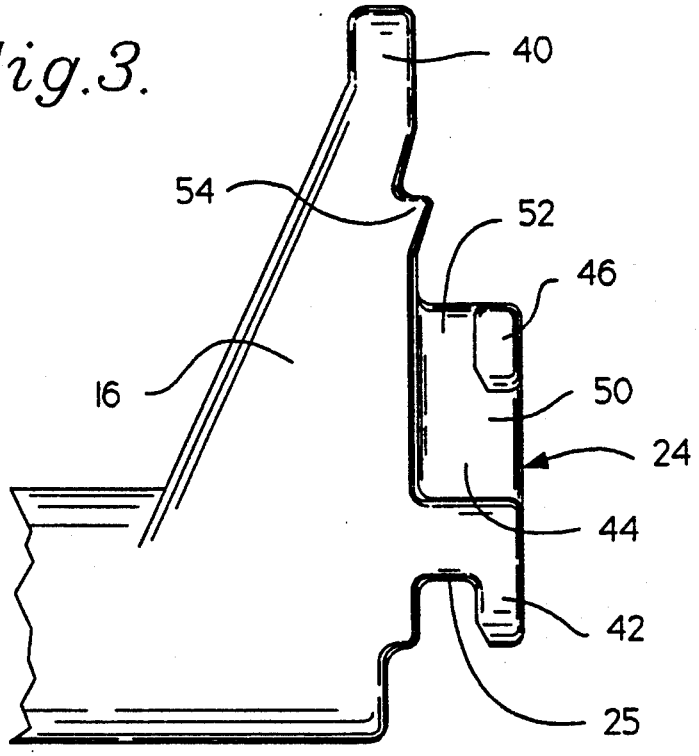
FIG. 3 is a back view of a portion of a brace of the base of the toy riding apparatus of FIG. 1.

As can be seen from FIG. 3, which shows an end portion of one of the braces 16 (the opposite end portion being a mirror image of FIG. 3), each of the braces 16 includes on each end thereof an aforementioned male connector 24 and a stabilization extension 40. Each male connector 24 includes a hook 42 on the lower end thereof, a thin extension piece 44 extending from upwardly from the hook 42, and a pair of retaining pieces 46, 48 extending away from the extension piece 44, as shown in FIGS. 1 and 3. The extension piece 44 includes a lower section 50 which extends between the hook 42 and the retaining pieces 46, 48, and an upper section 52 which extends between the brace 16 and the retaining pieces 46, 48.

The base 12 is assembled by connecting two side pieces 14 to two braces 16 as shown in FIG. 1. Specifically, each brace 16 is connected to each side piece 14 in the following manner. The male connector 24 of a brace 16 is aligned with a female connector 22 of a side piece 14 such that the hook 42 is immediately behind the lower section 38 of the connecting slot 26, the lower section 50 of the extension piece 44 is immediately behind the middle section 36 of the connecting slot 26, and the retaining pieces 46, 48 are immediately behind the upper section 34 of the connecting slot 26. The male connector 24 is then slid into the female connector 22 until the stabilization extension 40 contacts the side piece 14. The brace 16 is then moved downwardly until a top edge 33 of the lower retaining tab 32 contacts a lower inside edge 25 of the male connector 24, at which point the lower retaining tab 32 rests behind the hook 42 and the upper retaining tabs 28, 30 rest behind the retaining pieces 46, 48. The stabilization extension 40 then rests against the side piece 14 to held stabilize the connection between the side piece 14 and the brace 16. A small hook 54 on the brace 16 cooperates with a mating hook (not shown) on the side piece 14 to deter the brace 16 from accidentally moving upwardly relative to the side piece 14, and thus reduces the chance that the side piece 14 and the brace 16 will become accidentally disconnected.

As shown in FIG. 1, the toy riding apparatus 10 further includes a rider support device or bearing means 60 which is preferably formed in the shape of a horse. The rider support device 60 includes a body 62 which is roto-molded out of plastic, and a saddle 64 which is separately roto-molded out of plastic and then fastened to the body 62 by fasteners 66. The saddle 64 has a thinner wall thickness than the body 62, and it is consequently more deformable. The saddle 64 thus feels softer, and it therefore is more comfortable for a rider.

Figure 8:
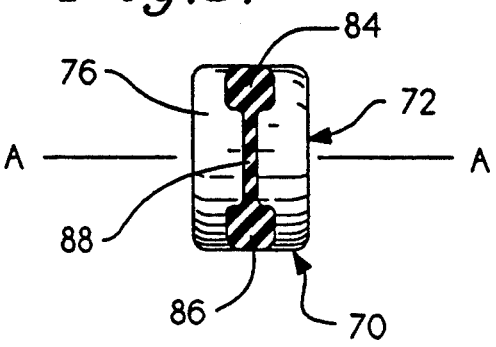
FIG. 8 is cross sectional view along line VIII—VIII of FIG. 5.

As shown in FIG. 1, the toy riding apparatus 10 also includes four elastomeric suspension bands 70 (three shown) which are connected between the rider support device 60 and the support posts 18 of the base 12 to suspend the rider support device 60 from the support posts 18. One of the elastomeric suspension bands 70 is shown in FIGS. 4–8. The band 70 is made of an elastomer, and includes two retaining sections or rotatable connecting means 72, 74 on either end thereof, which retaining sections 72, 74 are formed as right circular cylinders 76, 78 having right circular cylindrical holes 80, 82 therethrough. Extending between the retaining sections 72, 74 is an elastic flexing means, which includes two spaced band sections 84, 86 which are roughly rectangular in cross section, as seen in FIG. 8, and a web section 88 extending between the retaining sections 72, 74 and the band sections 84, 86.

The band 70 is preferably made of co-molded rubber. Specifically, the retaining sections 72, 74 are preferably molded out of a first type of rubber and the band sections 84, 86 and the web section 88 are preferably molded out of a second type of rubber, wherein the first type of rubber is harder than the second type of rubber. The first type of rubber is preferably a blended rubber having a hardness of about 90 shore "A" and the second type of rubber is preferably a blended rubber having a hardness of about 60 shore "A". The use of two types of rubber allows the band 70 to be made relatively stiff at the retaining sections 72, 74 to prevent elongation of the holes 80, 82 during use of the apparatus 10, and relatively more flexible at the band sections 84, 86 and the web section 88 to allow the band 70 to deliver a bouncy ride. Further, as seen an FIG. 8, in the direction defined by the axis A—A of the hole 80, the retaining section 72 (and consequently retaining section 74) is thicker than the band sections 84, 86, which are in turn thicker than the web section 88. The relative thickness of the retaining sections 72, 74 helps to increase the rigidity of the retaining sections 72, 74, and the relative thinness of the band sections 84, 86 increases their flexibility so they can deliver a more bouncy ride while still maintaining enough rigidity to support the weight of a child. The web section 88 is the thinnest of the sections, and is provided to prevent a child's hand or foot from being caught between the band sections 84, 86.

As seen in FIG. 1, the rider support device 60 has four support device pins 90 (two shown) attached thereto at spaced locations on the body 62 such that the pins 90 extend generally horizontally from the body 62. Each of the pins 90 extends through the hole 82 in the retaining section 74 of one of the bands 70 and the retaining section 74 is secured on the pin 90 by means of a cap 92 which is press fit, bolted, or otherwise attached to the pin 90. The retaining section 74 is thus able to rotate around the pin 90, and each of the bands 70 is thus rotatably connected to the rider support device 60.

Figure 9:
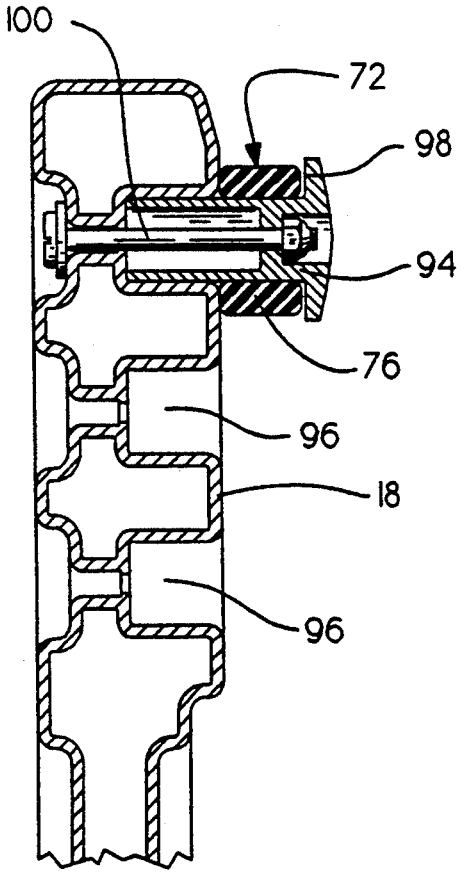
FIG. 9 is a sectional view of a connection between the band and the base of the toy riding apparatus of FIG. 1.
Figure 5:
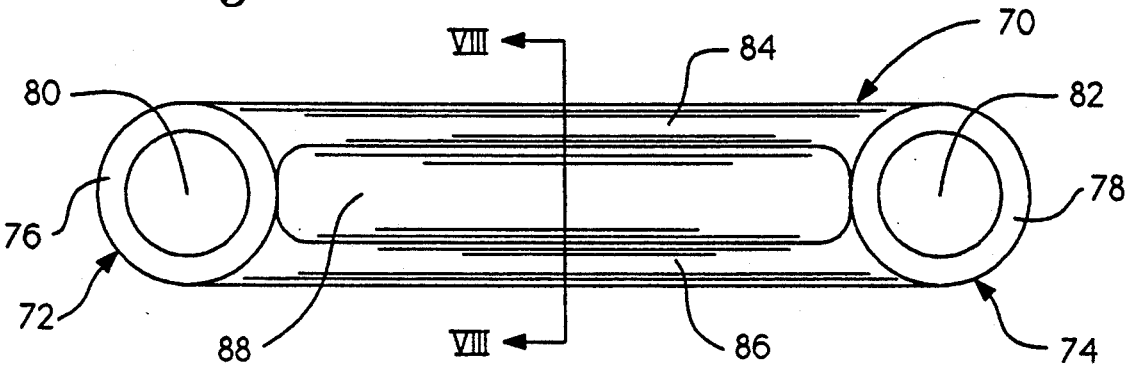
FIG. 5 is a front view of the band of FIG. 4.
Figure 6:
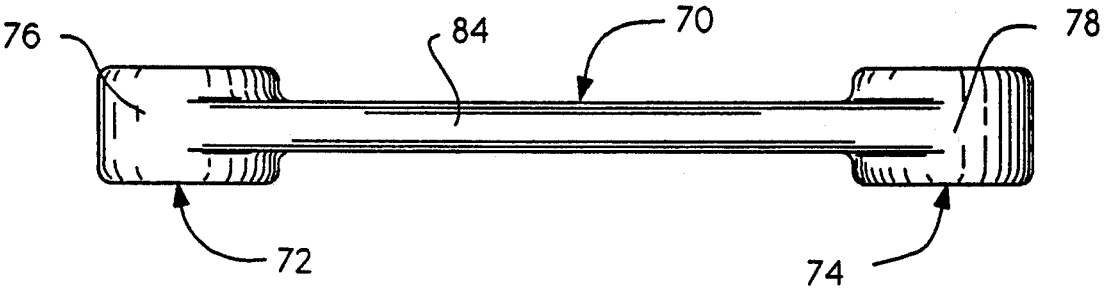
FIG. 6 is a top view of the band of FIG. 4.
Figure 7:
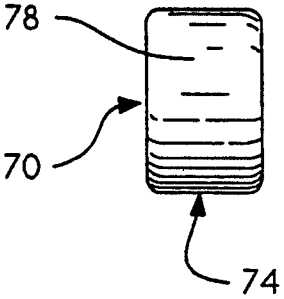
FIG. 7 is an end view of the band of FIG. 4.

The toy riding apparatus 10 further includes four support post pins 94, as seen in FIGS. 1 and 9. Each of the support posts 18 have a plurality of vertically spaced holes 96 therethrough, and each of the pins 94 extends into one of the holes 96 in one of the support posts 18, such that each support post 18 has one pin 94 extending therein. The plurality of holes 96 are provided in each support post 18 to act as means for adjusting the height at which the rider support device 60 will be suspended. As shown in FIG. 9, each pin 94 extends through the hole 80 in the retaining section 72 of one of the bands 70, and secures the band 70 on the pin 94 by means of a flange 98 and a bolt 100 which fastens the pin 94 to the support post 18. The retaining section 72 is able to rotate on the pin 94, and each of bands 70 is thus rotatably connected to one of the support posts 18.

With reference to FIGS. 1–9, the structure and operation of the toy riding apparatus 10 will now be explained. The base 12 of the toy riding apparatus 10 is assembled as detailed above, and the pins 94 are placed through the holes 80 in the retaining sections 72, and are secured in the holes 96 which are at a desired vertical height. The bands 70 are then connected to the pins 90 such that the rider support device 60 is elastically suspended from the support posts 18 by the bands 70. Once the toy riding apparatus 10 is in this assembled state, shown in FIG. 1, a child can mount the rider support device 60, using the integral step 20 if necessary, and sit in the saddle 64. As stated above, the saddle 64 has a thinner wall thickness than the body 62 of the rider support device 60, and is thus made more comfortable for the child. The child can then proceed to "ride" the toy riding apparatus 10, which involves shifting his or her weight on the rider support device 60. As the child's weight shifts, the load supported by each of the bands 70 varies, and thus the band sections 84, 86 and the web sections 88 elongate and shorten elastically in response to the varying load, and the bands 70 rotate relative to the rider support device 60 and the support posts 18 as the position of the rider support device 60 relative to each of the support posts 18 changes.

Because the retaining sections 72, 74 of each of the bands 70 are made of a relatively hard rubber, they will resist flexing and, thus, the holes 80, 82 through the retaining sections 72, 74 will resist elongation. The band sections 84, 86 and the web sections 88, since they are made of a softer rubber, will tend to elongate and shorten elastically with the varying load, but because they are made of an elastomer they will plastically deform relatively slowly so that the toy riding apparatus 10 will deliver a more natural feeling ride for a relatively long time. In addition, because the bands 70 are made of an elastomer, use of the toy riding apparatus will produce relatively little squeaking, making for a relatively quieter ride. Most importantly, however, the use of elastomeric bands 70 greatly reduces the number of potential pinch points presented by the suspension of the toy riding apparatus, which helps to make the toy riding apparatus 10 relatively safer to ride.

It is to be appreciated that, while not shown in the drawings, it is within the scope of the invention to form the rider support device 60 in other shapes than that of a horse. For instance, the rider support device 60 may be shaped as another type of animal, an automobile, an airplane, or a spaceship, among other things. Also, although three holes 96 are shown in each support post 18 in the drawing figures, more or fewer holes 96 may be provided to allow for larger or more precise adjustments in height, and advantages obtained therefrom. It is further within the scope of the invention for an elastomer other than a blended rubber to be used in the bands 70, for only one type of rubber to be used in the bands 70, or for the two types of rubber used in the bands 70 to be made of different hardnesses than those disclosed. The saddle 64 and the body 62 of the rider support device 60 may be formed of the same thickness of plastic, and advantages obtained therefrom.

Plastic parts which are disclosed as being blow molded may be roto-molded, and those which are disclosed as being roto-molded may be blow molded. It is also within the scope of the invention to form a second integral step near the bottom of each side piece 12. Further, it is to be understood that other means of securing the bands 70 to the rider support device 64 and the support posts 18 may be advantageously used.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A toy riding apparatus, comprising:

a base, said base including a plurality of support posts extending upwardly therefrom;

a rider support device; and a plurality of elastomeric suspension bands, each of said bands being connected between said rider support device and one of said plurality of support posts such that said rider support device is suspended from said support posts by said bands.

2. A toy riding apparatus as claimed in claim 1, wherein each of said elastomeric bands includes a pair of retaining sections having holes therethrough, and at least one band section which is made of an elastomer and which extends between said retaining sections.

3. A toy riding apparatus as claimed in claim 1, wherein each of said elastomeric bands includes a pair of retaining sections each having a hole therethrough, a pair of spaced band sections which are made of an elastomer and which extend between said retaining sections, and a web section which is made of an elastomer and which extends between said retaining and band sections.

4. A toy riding apparatus as claimed in claim 3, wherein said retaining sections are made of a first type of rubber and said band and web sections are made of a second type of rubber, said first type of rubber being harder than said second type of rubber.

5. A toy riding apparatus as claimed in claim 3, wherein, in a direction defined by an axis of one of said holes, said retaining sections are thicker than said band sections, and said band sections are thicker than said web section.

6. A toy riding apparatus as claimed in claim 1, wherein said rider support device has attached thereto a plurality of first pins, said support posts have attached thereto a plurality of second pins, and said bands each include a pair of retaining sections each having a hole therethrough, each of said bands having a first pin through one hole therein and a second pin through the other hole therein such that each of said bands extends between one of said first pins and one of said second pins.

7. A toy riding apparatus as claimed in claim 1, wherein each of said bands is rotatably connected to one of a plurality of first pins attached to said rider support device and one of a plurality of second pins attached to said support posts, each of said support posts including a plurality of vertically spaced holes therein, said second pins extending into at least some of said holes.

8. A toy riding apparatus as claimed in claim 1, wherein said base is made of plastic and includes an integral step to aid mounting of the rider support device.

9. A toy riding apparatus as claimed in claim 1, wherein said rider support device includes a body made of plastic and a saddle made of plastic, said saddle having a thinner wall thickness than said body.

10. A toy riding apparatus, comprising:

rider bearing means for bearing a rider during a riding motion;

base means, said base means including support means extending upwardly from said base means for supporting said rider bearing means; and suspension means for suspending said rider bearing means from said support means, said suspension means including a plurality of elastomeric band means which are connected between said rider bearing means and said support means.

11. A toy riding apparatus as claimed in claim 10, wherein each of said band means includes first and second rotatable connecting means for rotatably connecting said band means to said rider bearing means and said support means, respectively, and elastic flexing means for elastically flexing as said rider bearing means is ridden, said elastic flexing means being made of an elastomer and extending between said first and second connecting means.

12. A toy riding apparatus as claimed in claim 11, wherein said flexing means includes a pair of spaced band sections which are made of an elastomer and which extend between said first and second connecting means, and a web section which is made of an elastomer and which extends between said first and second connecting means and said band sections.

13. A toy riding apparatus as claimed in claim 11, wherein said first and second connecting means are made of a first type of rubber and said flexing means is made of a second type of rubber, said first type of rubber being harder than said second type of rubber.

14. A toy riding apparatus as claimed in claim 10, wherein said rider bearing means has attached thereto a plurality of first pin means, said support means has attached thereto a plurality of second pin means, and each of said band means includes first and second rotatable connecting means for rotatably connecting said band means to one of said first pin means and one of said second pin means, respectively.

15. A toy riding apparatus as claimed in claim 10, wherein said support means includes means for adjusting the height at which said rider bearing device is supported by said support means.

16. A toy riding apparatus as claimed in claim 10, wherein said base means is made of plastic and includes step means for stepping thereon and mounting the rider bearing device.

17. A toy riding apparatus as claimed in claim 10, wherein said rider bearing means includes a body made of plastic and a saddle made of plastic, said saddle having a thinner wall thickness than said body.

18. A rocking horse, comprising:

a base made of blow-molded plastic, said base including an integral step and four support posts extending upwardly from said base, each of said support posts having a plurality of vertically spaced holes therein;

a rider support device shaped like a horse, said rider support device including a body made of roto-molded plastic and a saddle made of roto-molded plastic, said saddle having a thinner wall thickness than said body;

four support device pins attached to said support device at spaced locations thereon;

four support post pins, each of said support post pins extending into one of said holes in one of said support posts, respectively;

four elastomeric bands, each of said bands including two spaced retaining sections on either end of said band which each have a hole therethrough, two spaced elastic band sections which extend between said retaining sections, and a web section which extends between said retaining sections and said band sections, said retaining sections being made of a first rubber and said band sections and said web section being made of a second rubber, said first rubber being harder than said second rubber, said retaining sections being thicker, in a first direction defined by the axes of said holes, than said band sections, and said band sections being thicker in said first direction than said web section;

wherein one of said support device pins and one of said support post pins extend through said holes of said retaining sections of each one of said bands, such that each of said bands is rotatably connected to said rider support device and one of said support posts, and said rider support device is thereby elastically suspended from said support posts by said bands.

* * * * *